US007395842B2

(12) United States Patent
Dyer

(10) Patent No.: US 7,395,842 B2
(45) Date of Patent: Jul. 8, 2008

(54) APPARATUS FOR FILLING AND REFILLING A FLEXIBLE CONTAINER

(75) Inventor: John J. Dyer, Shoreview, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 463 days.

(21) Appl. No.: 11/105,026

(22) Filed: Apr. 13, 2005

(65) Prior Publication Data

US 2005/0242122 A1 Nov. 3, 2005

Related U.S. Application Data

(60) Provisional application No. 60/566,316, filed on Apr. 29, 2004.

(51) Int. Cl.
*B65B 1/04* (2006.01)

(52) U.S. Cl. ..... 141/316; 141/10; 141/114; 141/314; 248/312; 248/313; 211/85.15

(58) Field of Classification Search ..... 211/85.15
See application file for complete search history.

(56) References Cited

U.S. PATENT DOCUMENTS 2,463,651 A * 3/1949 Stevens ..... 215/395
3,087,518 A 4/1963 Scholle
3,090,590 A * 5/1963 Hester ..... 248/346.06
3,403,826 A 10/1968 Buford
3,872,868 A * 3/1975 Kline ..... 604/403
4,099,598 A 7/1978 Clinard
4,784,360 A * 11/1988 Mok ..... 248/313
6,045,097 A * 4/2000 Gaffar ..... 248/95
6,357,713 B1 * 3/2002 BeBow ..... 248/300

FOREIGN PATENT DOCUMENTS

FR 2383832 10/1978

* cited by examiner

*Primary Examiner*—Timothy L Maust
(74) *Attorney, Agent, or Firm*—David B. Patchett

(57) ABSTRACT

An apparatus to aid in the filling or refilling of a flexible, collapsible container having a pour spout and a method for using same. The apparatus includes a center frame element having attached to its upper end an upper frame element adapted to receive at least a portion of the pour spout of the container. At its lower end, the center frame element is attached to a lower frame element adapted to cradle a lower portion of the container being filled and to urge the container toward the center frame element as the flexible, collapsible container fills and expands. The apparatus is portable and may be removably mounted to a variety of vertical or horizontal surfaces.

17 Claims, 4 Drawing Sheets

APPARATUS FOR FILLING AND REFILLING A FLEXIBLE CONTAINER

CROSS REFERENCE TO RELATED APPLICATION

This application claims the benefit of U.S. Provisional Patent Application No. 60/566,316, filed Apr. 29, 2004.

FIELD OF THE INVENTION

The invention relates to portable devices adapted to support a flexible, collapsible container during filling of the container.

BACKGROUND OF THE INVENTION

Flexible, collapsible containers such as bags or pouches are used for a variety of purposes. Liquid foods such as individual servings of salad dressing may be packaged in a sealed plastic pouch. The user cuts or tears a portion of the pouch to open it and dispense the contents. The emptied pouch may then be discarded. Bags or pouches of this type are not intended to be refilled after use.

Various collapsible bags or containers are known which are adapted to be filled with liquid contents, which may be dispensed through annular spouts or fitments. The walls of the bag are typically flexible sheets of a plastic, such as polyethylene, polypropylene, nylon, or polyester. The contents of the bag are dispensed through the spout or fitment in a wall of the bag. Often the spout has a replaceable cap or closure means thereby permitting the bag to be refilled and resealed after its initial use. The liquid contents can be foods, such as juices or milk, soaps or shampoos, or other liquids, such as photoprocessing solutions or cleaning chemicals. Often the collapsible bags are contained in a rigid support container. An example of this construction is the so-called "bag-in-box" whereby a rigid exterior box structurally supports the interior bag during filling, storage, shipment, and as the bag is being emptied.

It is known to use collapsible bags for dispensing liquids without the bag having a structural support such as a box. Flexible plastic containers having a resealable spout for filling the container and dispensing its contents are commonly used for travel, such as for camping. In addition, there are also mop handle assemblies adapted to dispense a liquid wherein the liquid supply reservoir may be a flexible, collapsible bag.

Filling a flexible container once the contents have been dispensed can be inconvenient for the user. A flexible, collapsible container typically has no external means of support and does not retain its filled shape when empty. Filling the container may require one person to hold the container while a second person fills it. Alternatively, one person may attempt to hold the container with one hand while keeping the spout in an upright position while directing the filling material into the spout with the other hand. Depending on the size of the container and the weight of the contents, this procedure may induce considerable stress at the point at which the container is being held, typically at the neck of the pour spout. Neither filling process is desireable when the contents of the container are potentially hazardous.

Although commercial manufacturing facilities may have equipment adapted to support and fill a collapsible container, a need exists for a convenient means for the end user to support and refill a flexible, collapsible container having a pour spout.

SUMMARY OF THE INVENTION

The present invention features a portable apparatus for supporting a flexible, collapsible container having a neck comprising a pour spout during filling or refilling of the container. The apparatus comprises a center frame element, an upper frame element attached to an upper portion of the center frame element, and a lower frame element attached to a lower portion of the center frame element. The upper frame element may be adapted to receive and support at least a portion of the neck of the container, and the lower frame element may be adapted to cradle at least a portion of the lower part of the container thereby helping to relieve stress and strain at the neck of the container due to the weight of the contents. When in use, the apparatus may be freestanding, may hang from an edge such as the rim of a drum, or may be mounted on a surface.

The above summary is not intended to describe each illustrated embodiment or every implementation of the present invention. Other features and advantages of the invention will be apparent from the figures and the detailed description which follow, and from the claims.

DETAILED DESCRIPTION

In one aspect, the present invention provides a portable apparatus for stabilizing the container when filling or refilling a flexible, collapsible container having a spout for dispensing the contents thereof. Exemplary containers may be obtained commercially from, for example, Scholle Corporation, Irvine, Calif. The apparatus of the invention can support and cradle the container, thereby reducing or eliminating stress on portions of the container during the refill process. The apparatus can be adapted to receive containers ranging in size from a few ounces up to 5 gallons or more. The apparatus allows for easy forward loading and unloading of the container. The apparatus is designed to support the container during filling so as to minimize stress on the refill spout and to ensure the refill spout holds its position during the refilling operation. Although other methods of introducing material into the container may be employed, filling of the container using the apparatus of the present invention is conveniently accomplished by gravity feed. As used herein, the term "material" is intended to include flowable granular or powdered solids and liquids.

In another aspect, the present invention provides a portable apparatus which may be removably mounted to a generally vertical support surface such as the side of a trash container, janitorial sink, mop bucket, chemical drum, wheelbarrow, wall and the like, thereby making the apparatus convenient for one person to use.

In yet another aspect, the present invention provides a portable apparatus which is free-standing and stable in use on a generally horizontal surface and requires no mounting to a support surface. This further increases the convenience of refilling a container.

Figure 1A:
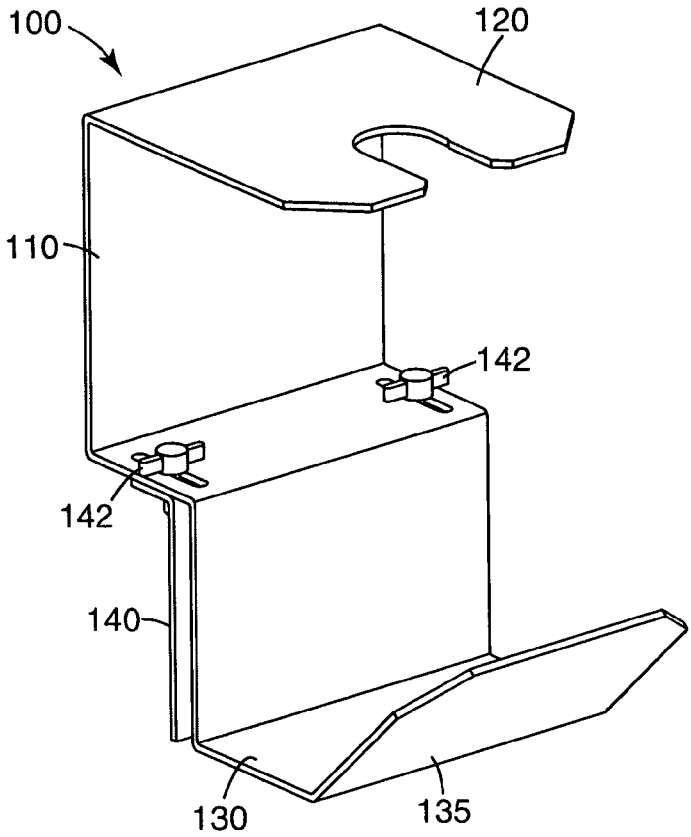
FIG. 1*a* is a diagram showing a perspective view of an embodiment of the present invention.

As depicted in FIG. 1*a*, the inventive apparatus 100 generally comprises a structure having an upper frame element 120 adapted to receive and support at least a portion of the container pour spout (not shown), a lower frame element 130 adapted to cradle and support a bottom portion of the container, and a center frame element 110 attached at one end to the upper frame element 120 and attached at the other end to the lower frame element 130.

The upper frame element 120 may be constructed, for example, with a spout support notch 150 which is adapted to receive and support at least one element of the container spout or fixment. For example, if the container spout assembly comprises a flange, spout support notch 150 may be sized so that all or a portion of the flange rests on an edge of the notch 130. Alternatively, if the container spout assembly comprises a necked-in portion, the notch 130 may be configured to receive the necked-in portion of the spout assembly.

The lower frame element 130 is generally disposed below the upper frame element 120. The lower frame element 130 is also disposed in sufficient proximity to the upper frame element 120 so that a bottom portion of the container to be filled rests on the lower frame element 130 thereby permitting the lower frame element 130 to provide support to the container as it is filling with liquid or other material. Such support helps relieve stress and strain at the neck portion of the container as the weight of the container increases.

The lower frame element 130 may include a lip 135 which is disposed somewhat upwardly and away from the center frame support 110 of the apparatus 100. During filling of the container and the expected change in position of the flexible container walls as filling proceeds, the lip 135 urges the container toward the rear portion of the apparatus 100 to prevent the container from falling off the lower frame element 130 and creating strain at the neck of the container.

The center frame element 110 connects the upper (120) and lower (130) frame elements and provides structural support for the apparatus.

Figure 1B:
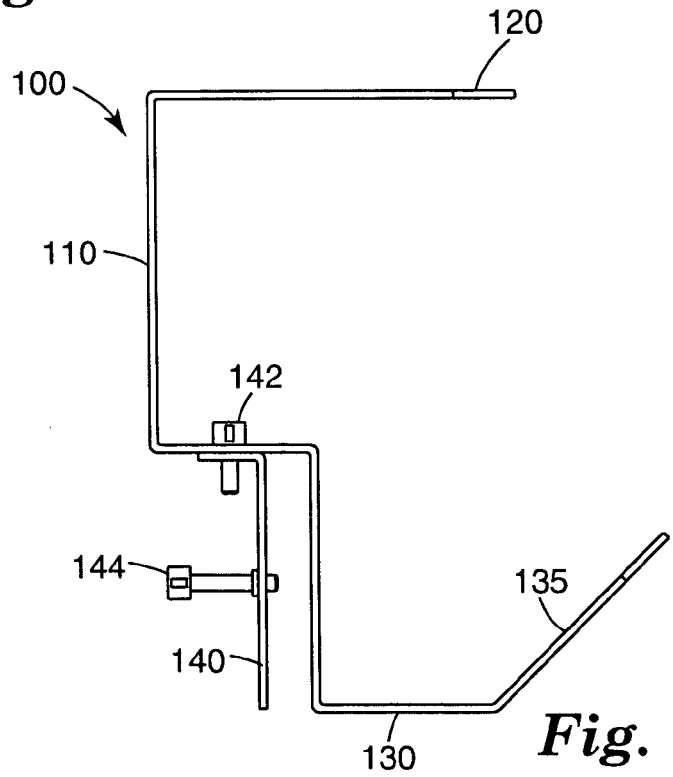
FIG. 1*b* is a diagram showing a side view of the embodiment depicted in FIG. 1*a*.

FIG. 1*b*, being a side view of the embodiment depicted in FIG. 1*a*, shows more clearly the clamping means, which, in this embodiment, is defined by a portion of the lower frame element 130 adjacent the clamp bracket 140, which is movably attached to a portion of the lower frame element 130 by means of, for example, the thumbscrews 142 (142 in FIG. 1*a*). The clamping means may be used to secure the apparatus 100 to a generally vertical surface such as the side of a trash container, sink, bucket, wheelbarrow, wall and the like. Optional set screw 144 may be used to help stabilize the apparatus 100 when clamped onto the vertical surface.

An advantage of the embodiments depicted in FIGS. 1*a* and 1*b* is the height of the upper frame element 120 relative to the position of the clamping means. In some cases, it may be ergonomically favorable for the user to handle the refillable container at about arm or shoulder level. The lower positioning of the clamping means depicted in FIGS. 1*a* and 1*b* tends to position the top of the refillable container (not shown) substantially higher than the top of the clamping means. This could be beneficial to the user when, for example, the master container, that is, the container holding the bulk of the material to be used for filling the flexible, collapsible container, resides in an elevated location such as on an upper shelf.

Figure 2A:
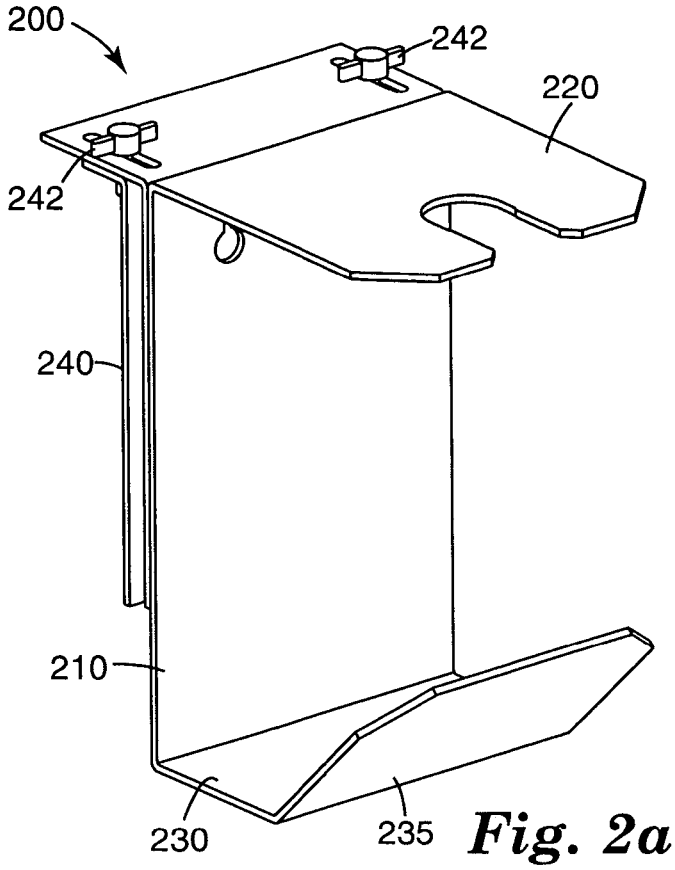
FIG. 2*a* is a diagram depicting a perspective view of another embodiment of the present invention.
Figure 2B:
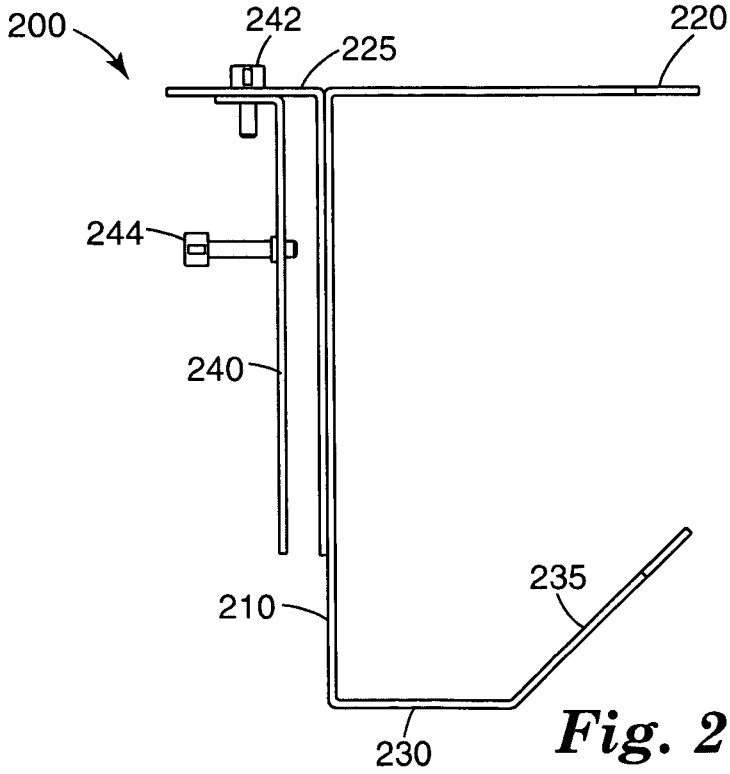
FIG. 2*b* is a diagram depicting a side view of the embodiment of FIG. 2*a*.

Another embodiment of the present invention, as depicted in FIGS. 2A and 2B, permits the apparatus 200 to be mounted to a generally vertical surface at a lower level than the embodiment depicted in FIGS. 1A and 1B. Referring, for example, to FIG. 2*b*, when a container is positioned in the apparatus 200 for refilling, and when the apparatus is attached to a generally vertical surface, the clamping means defined by the clamp bracket 240, a portion of the center frame element 210 and the upper frame element extension 225 permits the neck of the container to be filled (not shown) to be adjacent the top of the apparatus 200.

In a modification of the embodiment of FIGS. 2*a* and 2*b*, the clamp bracket 240 and the thumbscrews 242 could be eliminated and the upper frame element extension 225 could be bent in a downwardly direction to form a hook or U-shaped element which would then be useful for hanging the apparatus from an edge, for example, on a container such as a metal 55-gallon metal drum, to enable refilling of a container from a drum pump.

Figure 3:
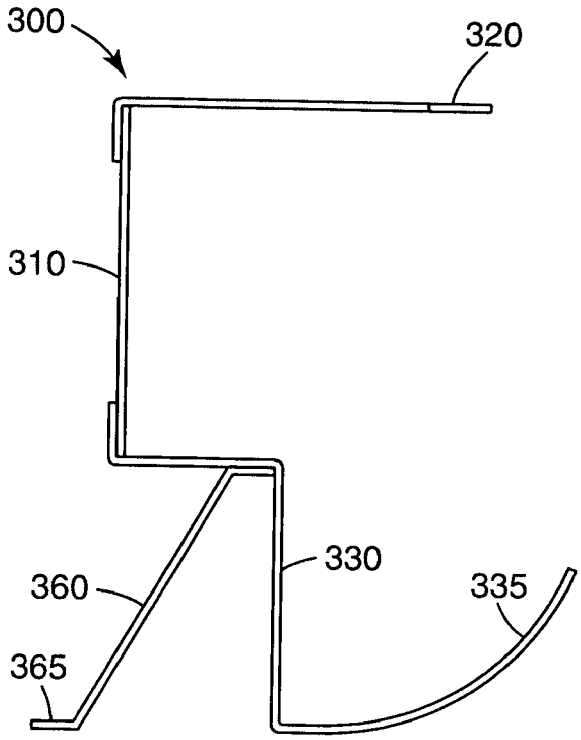
FIG. 3 is a diagram showing a side view of yet another embodiment of the present invention.

Whereas previous figures have depicted unitary or integral construction of the upper, center and lower frame elements such as might be achieved by a molding or stamping manufacturing process, FIG. 3 depicts yet another embodiment of the present invention in which the upper frame element 320, center frame element 310 and lower frame element 330 are manufactured as separate pieces and assembled together by known means such as welds, rivets, bolts, screws, adhesive and the like. In this embodiment, a support leg 360, similarly attached to a portion of the lower frame element 330, is provided to act in concert with the lower frame element 330 and the lower frame element lip 335 to stabilize the apparatus 300 on a generally horizontal surface as a free-standing device. The support leg 360 may be attached to a different part of the apparatus 300 such as a portion of the upper frame element 320 or the center frame element 310 as would be understood by one of ordinary skill in the art of designing and/or manufacturing such devices. The support leg 360 may also be provided with an optional support foot 365 to increase the stability of the apparatus 300 on a surface.

Figure 4:
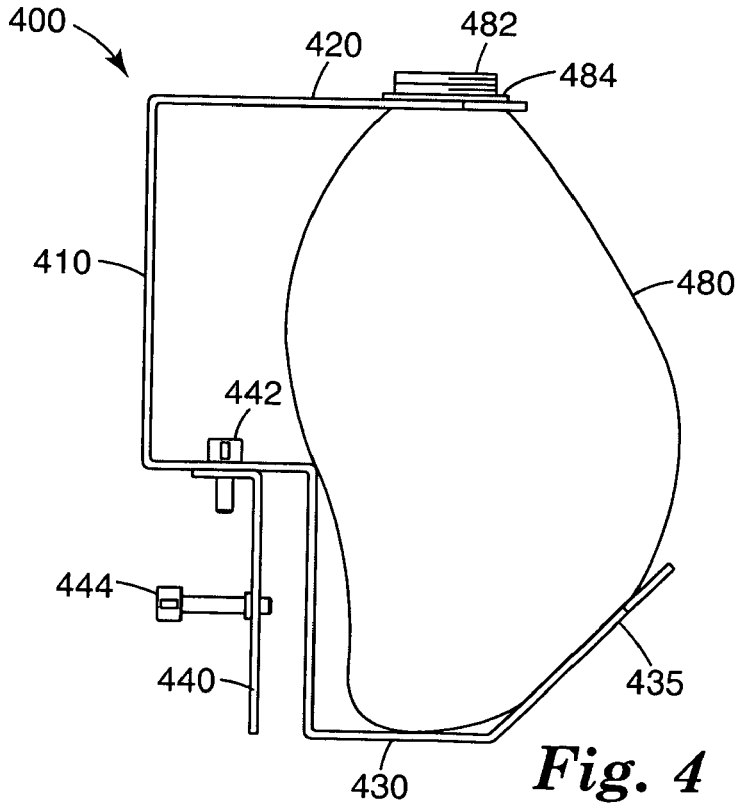
FIG. 4 is a diagram depicting inventive apparatus of FIG. 1*a* with partially filled flexible container in place.

FIG. 4 depicts a partially filled flexible container supported by the embodiment of the present invention shown in FIGS. 1*a* and 1*b*. In this example, bag, pouch or other flexible container 480 has a neck portion defined by a pour spout 482 and an annular flange 484 coaxial with the pour spout and disposed between the spout and the body of the bag 480. The user of the apparatus, that is, the person refilling the bag, slides the neck portion of the bag into the spout support notch (150 in FIG. 1*a*) so that the flange 484 rests on the upper frame element 420. The lower portion of the bag 480 rests on and is cradled by the lower frame element 430 and the lower frame element 435. With the bag now in place in the apparatus, the user may use both hands to pour or otherwise dispense liquid or other material into the bag.

Figure 5:
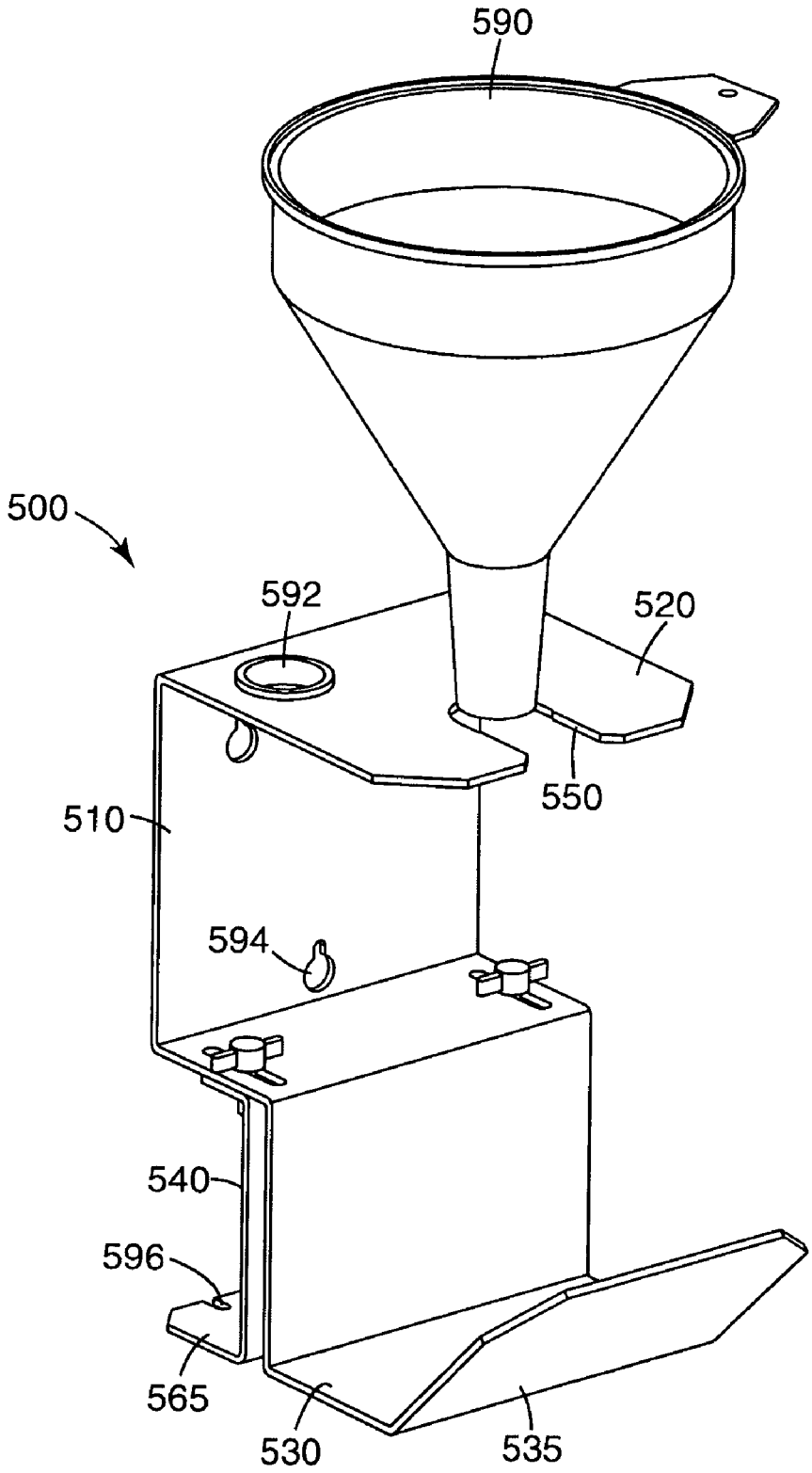
FIG. 5 is a diagram showing a perspective view of yet another embodiment of the present invention.

FIG. 5 depicts additional optional features which may be associated with the use of an apparatus of the present invention.

For example, a funnel 590 or other filler spout or tube may be attached or located adjacent to a portion of upper frame element 520 to assist in filling the container. A drip cup 592 may be adapted to receive the dispensing end of the funnel or other filler spout or tube and disposed on or adjacent the upper frame element 520 to prevent residual material from dripping onto the work surface after a filling operation has been completed.

One or more mounting holes 594 or slots may be disposed in the center frame element or lower frame element, for example, to enable mounting of the inventive apparatus to a vertical surface. One or more mounting slots 596 or holes may be disposed in the support foot or lower frame element, for example, to enable mounting of the inventive apparatus to a horizontal surface. Optional mounting to a vertical or horizontal surface may also be achieved with various adhesive materials such as double-sided tape and hook and loop fasteners.

The clamp bracket 540 may be adapted to include a support foot 565.

One or more portions of the apparatus, such as the center frame element 510, for example, may be formed with curvature to better conform to a particular mounting surface.

The frame elements may be made of metal such as aluminum, brass, steel, titanium; engineering plastics such as nylon, and polypropylene; wood, and other materials with suitable modulus or rigidity to support the apparatus and the filled container.

The upper frame element 120 in FIG. 1*a* or the spout support notch 150 may comprise interchangeable portions to enable the apparatus readily to accommodate containers of differing capacities or spout neck structures.

It will be apparent to those skilled in the art that many changes can be made in the embodiments described without departing from the scope of the present invention. Thus, the scope of the present invention should not be limited to the structures and methods described in this application, but only by the structures and methods described by the language of the claims and the equivalents thereof.

What is claimed is:

1. An apparatus for stabilizing the filling or refilling of a flexible, collapsible container having a spout for dispensing the contents thereof, the apparatus comprising: a clamping device for removably clamping said apparatus to a surface other than the flexible, collapsible container;

a center frame element having a first end and a second end;

an upper frame element attached to the first end of the center frame element and adapted to receive at least a portion of the spout; and a lower frame element attached to the second end of the center frame element, the lower frame element having a first segment extending from the center frame element and a lip extending from the first segment upwardly and away relative to the second end of the center frame element and wherein the lip and the upper frame element are not substantially parallel.

2. The apparatus of claim 1, wherein the lower frame element is adapted to cradle at least a portion of the container.

3. The apparatus of claim 1, wherein the clamping device comprises a clamp attached to at least one of the upper frame element, the lower frame element and the center frame element.

4. The apparatus of claim 1 wherein the upper frame element is integral with the center frame element.

5. The apparatus of claim 1, wherein the lower frame element is integral with said center frame element.

6. The apparatus of claim 1, further comprising a support leg attached to at least one of the upper frame element, the lower frame element and the center frame element.

7. A method of filling a flexible, collapsible container comprising:

(a) providing a flexible, collapsible container having a spout;

(b) providing an apparatus comprising (i) a center frame element having a first end and a second end;

(ii) an upper frame element attached to the first end of the center frame element and adapted to receive at least a portion of the spout; and (iii) a lower frame element attached to the second end of the center frame element, the lower frame element having a first segment and a lip extending therefrom, wherein the lip and upper frame element are not substantially parallel; and (iv) a clamping device;

(c) removably clamping the clamping device to a surface other than the flexible, collapsible container;

(d) providing a material for filling the container;

(e) engaging at least a portion of a neck portion of the container with said upper frame element;

(f) positioning at least a portion of the container onto the lower frame element; and (g) causing material to enter the container through the spout.

8. The apparatus of claim 1, further comprising a drip cup disposed on the upper frame element.

9. The apparatus of claim 1, wherein the center frame element forms at least one mounting hole.

10. The apparatus of claim 1, further comprising a support leg attached to one of the upper frame element, the center frame element and the lower frame element.

11. The apparatus of claim 10, wherein the support leg includes a support foot.

12. The apparatus of claim 3, wherein the clamp includes a clamp bracket slidably associated with one of the upper frame element, the center frame element, and the lower frame element.

13. The apparatus of claim 12, wherein the upper frame element, the center frame element, and the lower frame element combine to define a first major side of the apparatus at which a flexible container is received, and further wherein the clamp bracket is positioned to generate a clamping zone relative to a second major side of the apparatus, opposite the first major side.

14. The apparatus of claim 13, wherein the first segment of the lower frame element includes a first horizontal section extending from the center frame element, a vertical section extending from the first horizontal section, and a second horizontal section extending a front face of the vertical section opposite the first horizontal section, the lip extending from the second horizontal section, and further wherein the clamp bracket is positioned adjacent a rear face of the vertical section such that the clamping zone is established between the clamping bracket and the rear face of the vertical section.

15. The apparatus of claim 13, wherein the upper frame element projects forwardly of a front face of the center frame element, and further wherein the clamp bracket is positioned rearwardly of a rear face of the center frame element such that the clamping zone is established between the clamp bracket and the rear face of the center frame element.

16. The apparatus of claim 12, wherein the clamp further includes a set screw assembled to the clamp bracket.

17. The method of claim 7, wherein removably clamping the clamping device includes removably assembling the clamping device to a vertical surface.

* * * * *